United States Patent [19]

Gamble et al.

[11] 4,398,367

[45] Aug. 16, 1983

[54] PROTECTOR FOR MUZZLE LOADING RIFLE

[76] Inventors: Clarence M. Gamble, R.D. #1, Old Youngstown Rd., Edinburg, Pa. 16116; Frank Stone, Jr., 1706 Gretchen Ave., New Castle, Pa. 16101

[21] Appl. No.: 277,663

[22] Filed: Jun. 26, 1981

[51] Int. Cl.[3] ..... F41C 27/08

[52] U.S. Cl. ..... 42/1 N

[58] Field of Search ..... 42/1 N

[56] References Cited

U.S. PATENT DOCUMENTS

| | | | |
|---|---|---|---|
| 3,574,965 | 4/1971 | Seiger | 42/1 N |
| 4,328,634 | 5/1982 | Wiltrout | 42/1 N |
| 4,348,829 | 9/1982 | Bosco et al. | 42/1 N |

FOREIGN PATENT DOCUMENTS

| | | | |
|---|---|---|---|
| 23895 | of 1915 | United Kingdom | 42/1 N |

*Primary Examiner*—Charles T. Jordan

*Attorney, Agent, or Firm*—Stephen Ross Green

[57] ABSTRACT

This invention is directed to a device for protecting the flint, flash pan, and hammer, and the powder contained in the flash pan of a muzzle-loading rifle. The disclosed invention includes a cover which envelops the hammer, flint, flash pan and powder contained therein. The cover is secured to a band which is removably attached to the barrel and forestock of the rifle in proximity to the flash pan and hammer.

Fasteners are provided such that the cover may be secured around the flash pan and hammer and the band may be secured around the barrel of the rifle in proximity to the hammer and flash pan of the rifle.

4 Claims, 3 Drawing Figures

PROTECTOR FOR MUZZLE LOADING RIFLE

This invention relates to a protector for a muzzle loading rifle.

More specifically, a mechanism is disclosed for protecting the flint, flash pan, and hammer, and the powder contained in the flash pan of a muzzle-loading rifle. The disclosed invention includes a cover which envelops the hammer, flint, flash pan and powder contained therein. The cover is secured to a band which is removably attached to the barrel and forestock of the rifle in proximity to the flash pan and hammer.

Fasteners are provided such that the cover may be secured around the flash pan and hammer and the band may be secured around the barrel of the rifle in proximity to the hammer and flash pan of the rifle.

DESCRIPTION OF THE PRIOR ART

Several devices presently exist which facilitate the loading of a muzzel-loading rifle. Once the rifle is loaded, however, it must be fired within a relatively short time period to avoid possible spillage of the powder contained in the flash pan, breakage of the flint, or during adverse weather conditions, dampening of the powder in the flash pan. Notwithstanding these potential difficulties, when using a muzzle loading rifle for hunting purposes, it is desirable to load the weapon and carry same until such time as quarry is sighted and may be fired upon. The hammer, flint, and flash pan which are a part of virtually all muzzle-loading rifles are thus exposed to the elements and under damp conditions, the powder may fail to ignite when struck by the spark from the flint. Alternatively, when it is no longer desirable to use the weapon, there is danger than an inadvertent bump or jostle of the hammer will cause the flint to emit a spark which may ignite residual powder remaining in the flash pan. This is an especially hazardous condition when carrying the weapon through the woods with the flash pan and hammer exposed to hanging branches and vegetation.

It is therefore an object of this invention to provide a protector for the muzzle-loading rifle which will protect the flash pan and powder contained therein from the effects of damp weather.

A further object of the invention is to provide a protector which may be readily removed from the flash pan when quarry is sighted.

Yet another object of the invention is to provide a protector which will protect the firing mechanism of the rifle during storage.

Still another object is to provide a protector for a muzzle-loading rifle which will protect the hammer and flint from bumping or jostling thereby preventing the emission of a spark which might strike residual powder in the flash pan.

A further object of the invention is to provide a protector which may be removed from the hammer and flash pan assembly for use of the rifle yet will remain attached to the rifle so as not to be lost.

In the attaining of the foregoing objects, the invention provides a protector for a muzzle-loading rifle which invention includes a cover which is suitably contoured so as to receive and enclose the hammer and flash pan assembly of the rifle. At either end of the cover are fasteners which may be interconnected so that the cover encloses the hammer and flash pan assembly. Integral with the cover is a band which wraps around the barrel and forestock of the rifle in proximity to the hammer and flash pan. At either end of the band fasteners are provided to interconnect the ends of the band so that the band may be secured to the barrel and forestock whether or not the cover encloses the flash pan and hammer of the rifle.

Other objects and advantages of the present invention will become apparent from the ensuing description of an illustrative embodiment thereof, in the course of which reference is made to the accompanying drawings in which:

FIG. 1 illustrates a view of the preferred embodiment of the invention about to be used in conjunction with a muzzle-loading rifle, and FIG. 2 is a view of the preferred embodiment of the invention in use with such a rifle, the cover enclosing the hammer and flash pan, and the band enclosing the barrel and forestock of the rifle, and FIG. 3 is a view from the top of the preferred embodiment of the invention in use with a muzzle loading rifle.

DESCRIPTION OF THE PREFERRED EMBODIMENT

Figure 1:
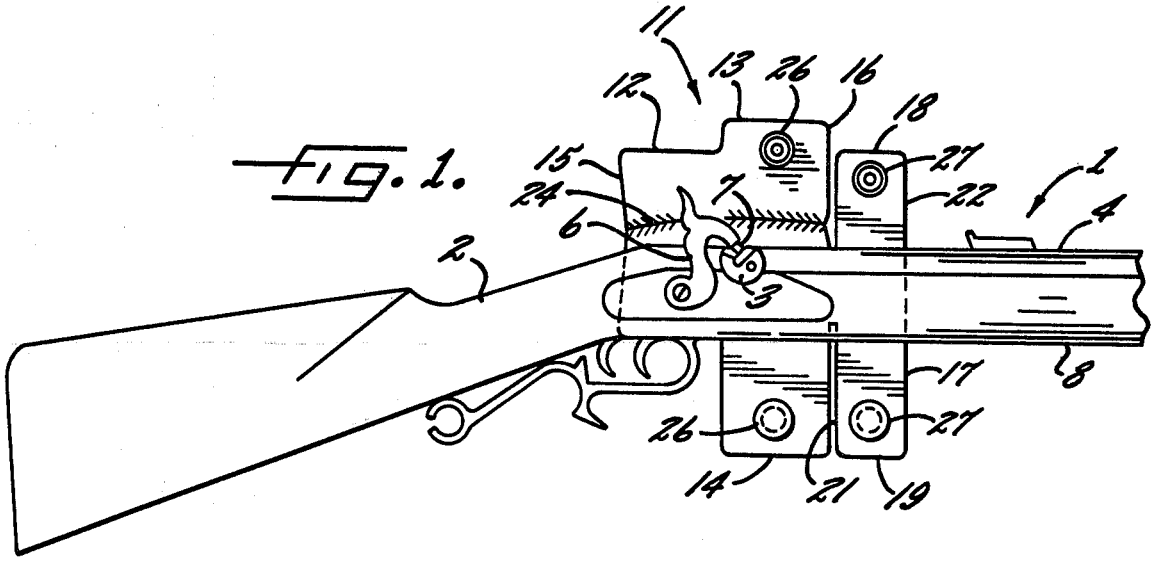
Figure 2:
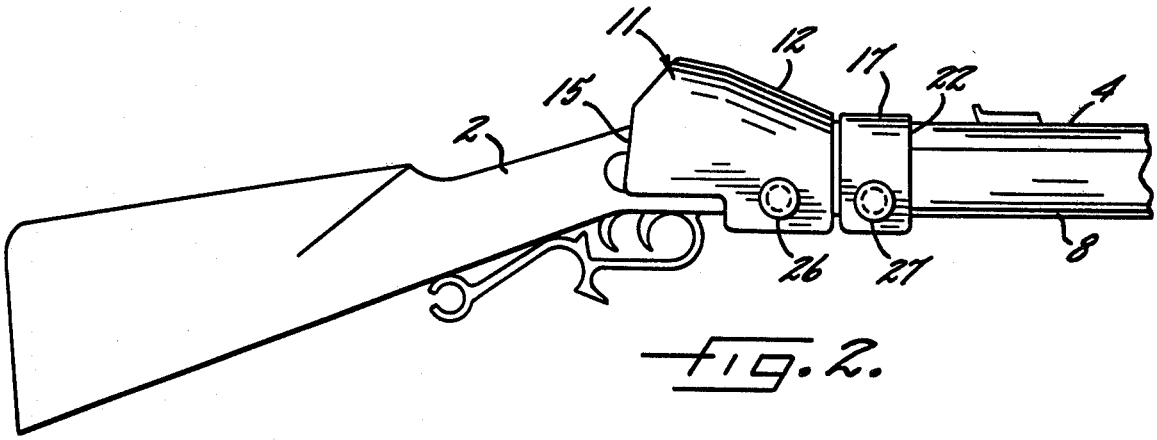

A clearer understanding of the invention will be obtained if FIG. 1 and FIG. 2 are studied in conjunction with the description that follows.

Figure 3:
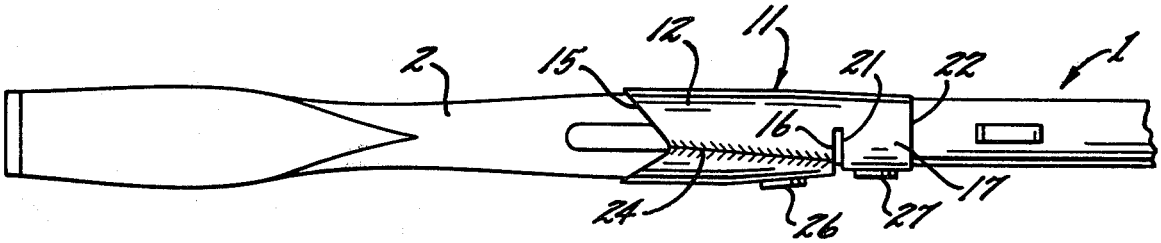

Referring to FIG. 1, there is shown a muzzle-loading rifle generally indicated by reference numeral 1 which shows a stock 2, a flash pan 3, a barrel 4, a hammer 6, and flint 7, and a forestock 8. A protector for muzzle-loading rifle 1 is generally indicated by reference numeral 11. The protector is disclosed as having cover 12, which cover 12 has first end 13, second end 14, first edge 15, and second edge 16. Cover 12 is further disclosed as being contoured or configured such that it may receive and enclose hammer 6, flash pan 3, barrel 4 and forestock 8 of muzzle-loading rifle 1. In the preferred embodiment, protector 11 may be fabricated from any number of flexible, nonflammable materials such as rawhide or a flame retardant plastic as will hereinafter be more specifically described. A band 17 has first end 18, second end 19, first edge 21, and second edge 22. First edge 21 of band 17 is secured to second edge 16 of cover 12. (FIG. 3.) Band 17 is fabricated from substantially similar material to that from which cover 12 is fabricated, hence, band 17 and cover 12 are movable in relation to each other. Fastener 26 is provided at first end 13 and second end 14 of cover 12 and fastener 27 is provided at first end 18 and second end 19 of band 17 so that first end 13 and second end 14 of cover 12 may be interconnected when cover 12 encloses hammer 6, flash pan 3, barrel 4 and forestock 8 of rifle 1, and likewise first end 18 and second end 19 of band 17 may be interconnected when band 17 encloses barrel 4 and forestock 8. Fasteners 26 and 27 are disclosed in the preferred embodiment to be common snap connections; however, it should be apparent that any commercially available fastening means may be used in their place.

Although protector 11 may be formed by securing cover 12 as aforesaid to band 17, it should be apparent that cover 12 and band 17 may be integrally fabricated from a single piece of flexible material. Referring now to FIG. 1 and FIG. 3, cover 12 has been formed from a single piece of flexible material and is provided with stitching 24 so as to assume the appropriate contour to receive hammer 6, and flash pan 3.

OPERATION

Operation of the invention may be most easily understood by referring to FIGS. 1 through 3 in sequence. In use, protector 11 is placed adjacent to muzzle-loading rifle 1 and aligned such that protector 11 is on the side of the rifle opposite that of the flash pan 3 and hammer 6 as may be readily seen in FIG. 1 of the drawings. Cover 12 and its accompanying first end 13 and second end 14 are then drawn around and enclosed about hammer 6, flash pan 3, barrel 4, and forestock 8. At this point, first end 13 and second end 14 of cover 12 may be interconnected by fastener 26. Likewise, first end 18 and second end 19 and band 17 are drawn around and enclosed about barrel 4 and forestock 8. In similar fashion, first end 18 and second end 19 and band 17 are interconnected by fastener 27. In this position, the hammer 6, flint 7, the flash pan 3, are totally enclosed within cover 12 as may be seen by referring now to FIG. 2 and FIG. 3. Protector 11 may be removed from rifle 1 by reversing aforesaid steps.

Since fastener 26 on cover 12 and fastener 27 on band 17 may be operated independently of one another, band 17 may remain fastened about barrel 4 and forestock 8 while cover 12 is unfastened and placed aside because of the flexible nature of cover 12 and band 17. Hence, when using protector 11 in conjunction with rifle 1 which is loaded, when quarry is sighted, fastener 26 may be unfastened whereupon first end 13 and second end 14 of cover 12 may be loosened from flash pan 3 and hammer 6 and cover 12 may be placed aside. At this point, the muzzle-loading rifle is operable in its normal manner but yet protector 11 is still secured to barrel 4 and forestock 8 and hence is not readily lost or misplaced.

Based on the foregoing description, it may be seen that the present invention provides a protector for a muzzle-loading rifle which will protect the flash pan and powder contained therein from the effects of damp weather. Further, the protector may be readily removed from the hammer and flash pan when the rifle is to be fired and yet may still be secured to the rifle, such that it may not be misplaced. Finally, when attached, the protector fully encloses the flash pan and hammer to protect same during storage and also to provide safety when carrying the rifle through vegetation or branches which may inadvertently trip the hammer, setting off sparks to ignite residual powder in the flash pan.

Although but one embodiment of the present invention has been illustrated and described, it will be apparent to those skilled in the art that various changes and modifications may be made therein and without departing from the spirit of the invention, and the invention is only limited as set forth in the accompanying claims.

We claim:

1. A protector for a muzzle-loading rifle, said rifle having a flint, a forestock, a barrel, a flashpan and a hammer, said protector comprising:

(a) covering means adapted for covering and enclosing said forestock, said hammer and said flashpan; and (b) a band having a first edge and a second edge and a first end and a second end, said first edge of said band being flexibly secured to said covering means, said band further being able to enclose said barrel and said forestock of said rifle in proximity to said flashpan and hammer; and (c) fastening means secured to said first end and said second end of said band for interconnecting said first end of said band to said second end of said band when said band encloses said barrel and said forestock.

2. The protector of claim 1 wherein said covering means further comprises:

(a) a cover having a first edge and a second edge and a first end and a second end, said cover being contoured to receive and enclose said flint, said hammer, said forestock and said flash pan of said rifle; and (b) fastening means secured to said first end and said second end of said cover for interconnecting said first end of said cover to said second end of said cover when said cover receives and encloses said flint, said hammer, said forestock and said flash pan.

3. The protector of claim 2 wherein said cover and said band are integrally fabricated from a single piece of flexible material.

4. A protector for a muzzle-loading rifle, said rifle having a flint, a barrel, a forestock, a flash pan and a hammer, said protector comprising:

(a) a flexible cover having a first edge and a second edge and a first end and a second end, said cover being contoured to receive and enclose said hammer, said flash pan and said forestock of said rifle; and (b) fastening means secured to said first end and said second end for interconnecting said first end and said second end of said cover when said cover receives and encloses said hammer, said flash pan and said forestock; and (c) a flexible band having a first edge and a second edge and a first end and a second end, said first edge of said band being flexibly secured to said second edge of said cover, said band being adapted for closure about said barrel and forestock of said rifle; and (d) fastening means secured to said first end and said second end of said band for interconnecting said first end and said second end of said band when said band encloses said barrel and said forestock.

* * * * *